US006032998A

United States Patent [19]

Damour

[11] Patent Number: 6,032,998

[45] Date of Patent: Mar. 7, 2000

[54] POWER ASSISTED ROLL HANDLING APPARATUS

[75] Inventor: Jeffrey C. Damour, Wind Gap, Pa.

[73] Assignee: Converter Accessory Corporation, Inc., Wind Gap, Pa.

[21] Appl. No.: 09/187,235

[22] Filed: Nov. 5, 1998

Related U.S. Application Data

[60] Provisional application No. 60/069,959, Dec. 17, 1997.

[51] Int. Cl.[7] ..... B66C 1/54; B66C 13/08

[52] U.S. Cl. ..... 294/86.41; 294/67.5

[58] Field of Search ..... 294/67.2, 67.21, 294/67.22, 67.5, 81.3, 81.4, 93–97, 86.41, 103.2; 414/607, 608, 626, 754, 782, 758

[56] References Cited

U.S. PATENT DOCUMENTS

| | | | |
|---|---|---|---|
| 2,913,276 | 11/1959 | Collings | 294/86.41 X |
| 2,945,609 | 7/1960 | Benes et al. | 294/86.41 X |
| 2,999,716 | 9/1961 | Elberty | 294/86.41 |
| 3,695,460 | 10/1972 | Borriello | 294/86.41 X |
| 4,166,647 | 9/1979 | Schmidt | 294/86.41 |

*Primary Examiner*—Johnny D. Cherry
*Attorney, Agent, or Firm*—Patrick J. Pinto

[57] ABSTRACT

A power assisted roll handling attachment for a lifting apparatus. Its support frame includes a gearmotor assembly and guides and is adapted for attachment to the lifting apparatus. A movable roll support assembly includes a support beam, a roll core mandrel assembly and a rack member having a curved portion. The rack member is adapted for being driven by a drive member carried on the output shaft of the gear motor. The support beam has a cross section defined by a flanged portion and a web portion. The support beam is formed in an L-shape having a first end, a second end and a radial portion formed therebetween. The rack member is positioned in a spaced parallel relationship with the flange portion. The roll support assembly is supported by the guides. Selective energizing of the gearmotor moves the roll support assembly with respect to the support frame thereby moving any roll of material carried by the roll support assembly from a first angular position to a second angular position by movement through the radial portion. Selective linear movement may be provided at the first end or second end.

16 Claims, 3 Drawing Sheets

POWER ASSISTED ROLL HANDLING APPARATUS

This application claims the benefit of U.S. Provisional Patent Application 60/069,959 that was filed on Dec. 17, 1997.

BACKGROUND OF THE INVENTION

1. Field of the Invention

With regard to the classification of art, this invention is believed to be found in the general class entitled Handling, Hand And Hoist Line Implements and more particularly to those subclasses pertaining to hoist line attached L-shaped load supporting frames.

2. Description of Related Art

Hoist line implements for handling rolls of material are known in the prior art. Examples of the known prior art are U.S. Pat. No. 5,513,944 that issued to Cullen et all on May 7, 1996 and U.S. Pat. No. 5, 642,979 that issued to Cullen et al on Jul. 1, 1997. Each of the known patents employ an L-shaped support that is controlled by two hoist lines. While this arrangement is practical, when used as intended with the frame that attaches to forks of a fork lift truck, it has been determined that some applications for a roll turning apparatus do not enjoy the luxury of the space or area that is required for manipulation of a fork lift truck. It has also been determined that some processing lines do not have two hoist lines available to provide the separate lifting and turning motions for the roll of a material.

The present invention solves the needs identified above as well as others that will become apparent from the description below. The present invention provides a compact roll turning apparatus that is adapted for a single hoist line operation. This compact roll turning apparatus of the present invention also provides an integrally powered manipulation and control of the angular orientation of the roll of material as well as horizontal movement of the roll to or away from a roll supply stand. This powered manipulation and control may be performed in a substantially continuous motion.

SUMMARY OF THE INVENTION

The present invention may be briefly described as: a power assisted roll handling apparatus for attachment to a lifting apparatus that includes a support frame and a roll support assembly. The support frame includes an attaching means, a gearmotor assembly, and at least one guiding means. The roll support assembly includes a support beam, a roll core mandrel assembly, and a rack member. The support beam has a selected cross section and includes a flanged portion and a web portion. The flange portion further includes a first end, a second end and a radial portion. The radial portion is intermediate the first end and the second end thereby forming an L-shape support beam. The roll core mandrel assembly is located and attached to the support beam near one of the ends. The roll core assembly is further arrayed for selectively gripping an inside diameter of a core of roll of material. The rack member is attached and supported by the web portion. The rack member has a pitch line that is aligned in a spaced parallel relationship with the first end, the second end, and the radial portion. A curved portion of the pitch line shares a common center with the radial portion of the flanged portion. The flanged portion of the roll support assembly is movably carried and guided by the guiding means. The roll support assembly is selectively movable with respect to the support frame by engagement of a drive member of the gearmotor assembly with mating driven members along the pitch line of the rack member. Selective operation of the gear motor assembly displaces a center axis of the roll of material from a first angular position to a second angular position.

The present invention may be used in places having as little as 55.88 cm (22 in.) of head space above the roll.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode of the present invention. These specific embodiments, as shown in the accompanying drawings, may also include diagrammatic symbols for the purpose of illustration and understanding.

Figure 1:
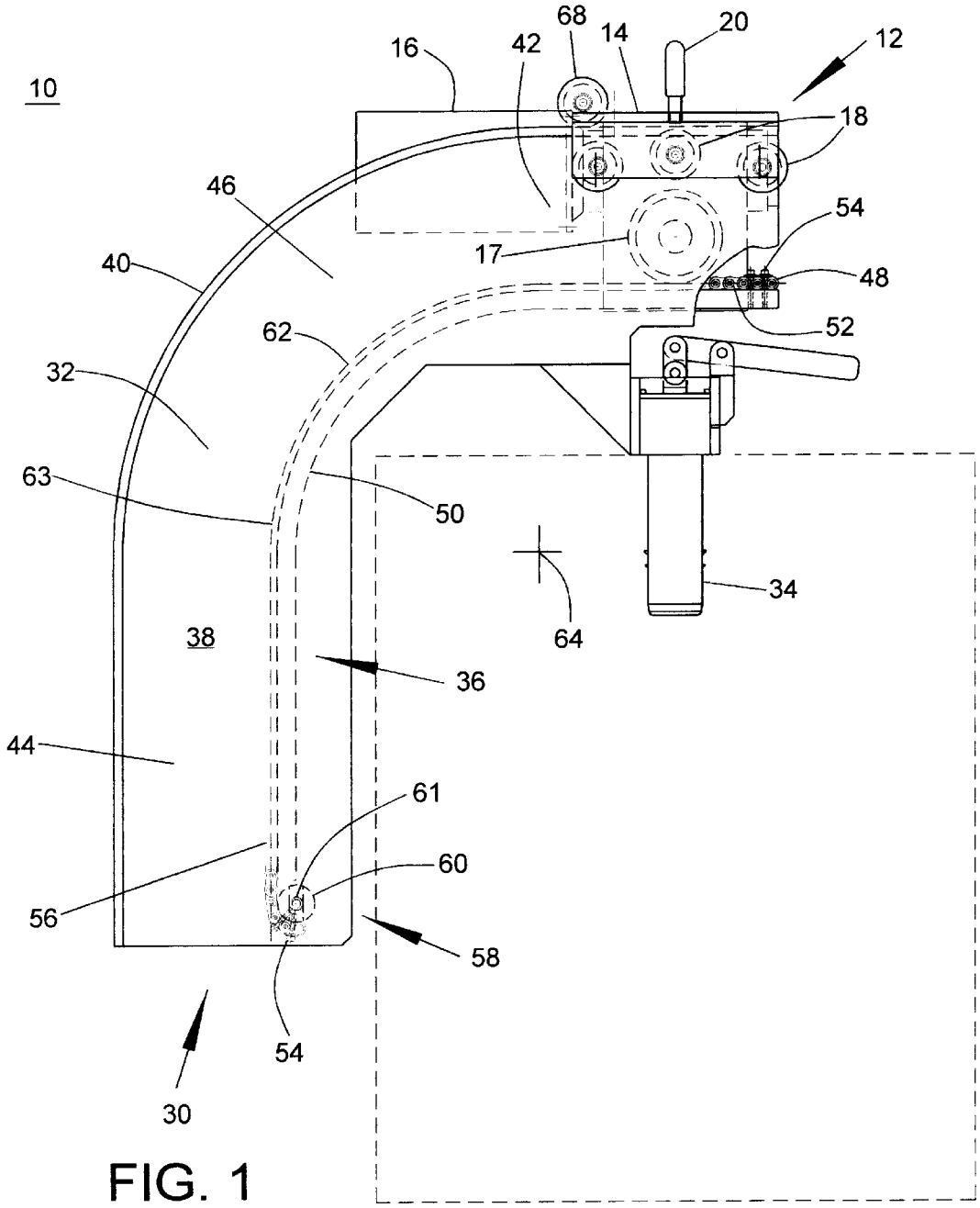
FIG. 1 represents a front elevation of the power assisted roll turning apparatus of the present invention showing the roll support assembly in a first position, this view also showing a roll of material, to be turned, in dashed outline in a substantially vertical position.

In the following description and in the appended claims, various components are identified by specific names for convenience. These names are intended to be generic in their application while differentiating between the various components. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 2:
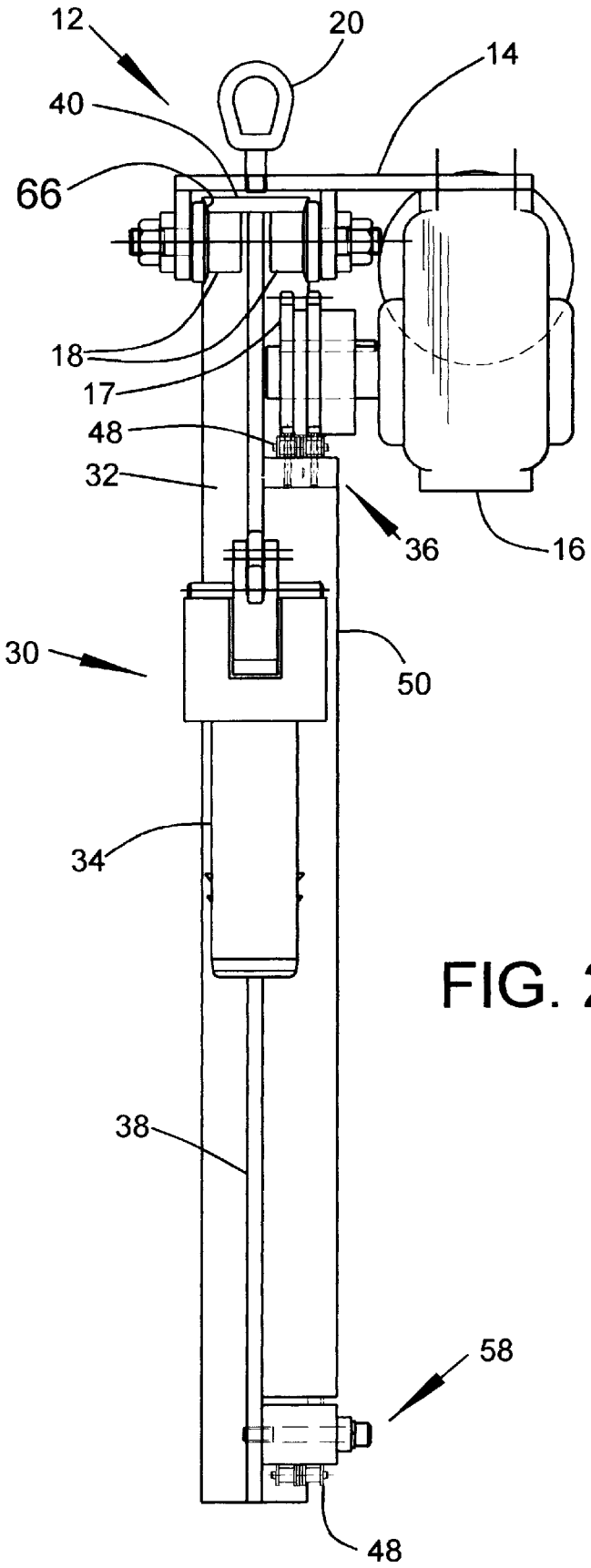
FIG. 2 represents a right side elevation of the present invention in a slightly enlarged scale.
Figure 3:
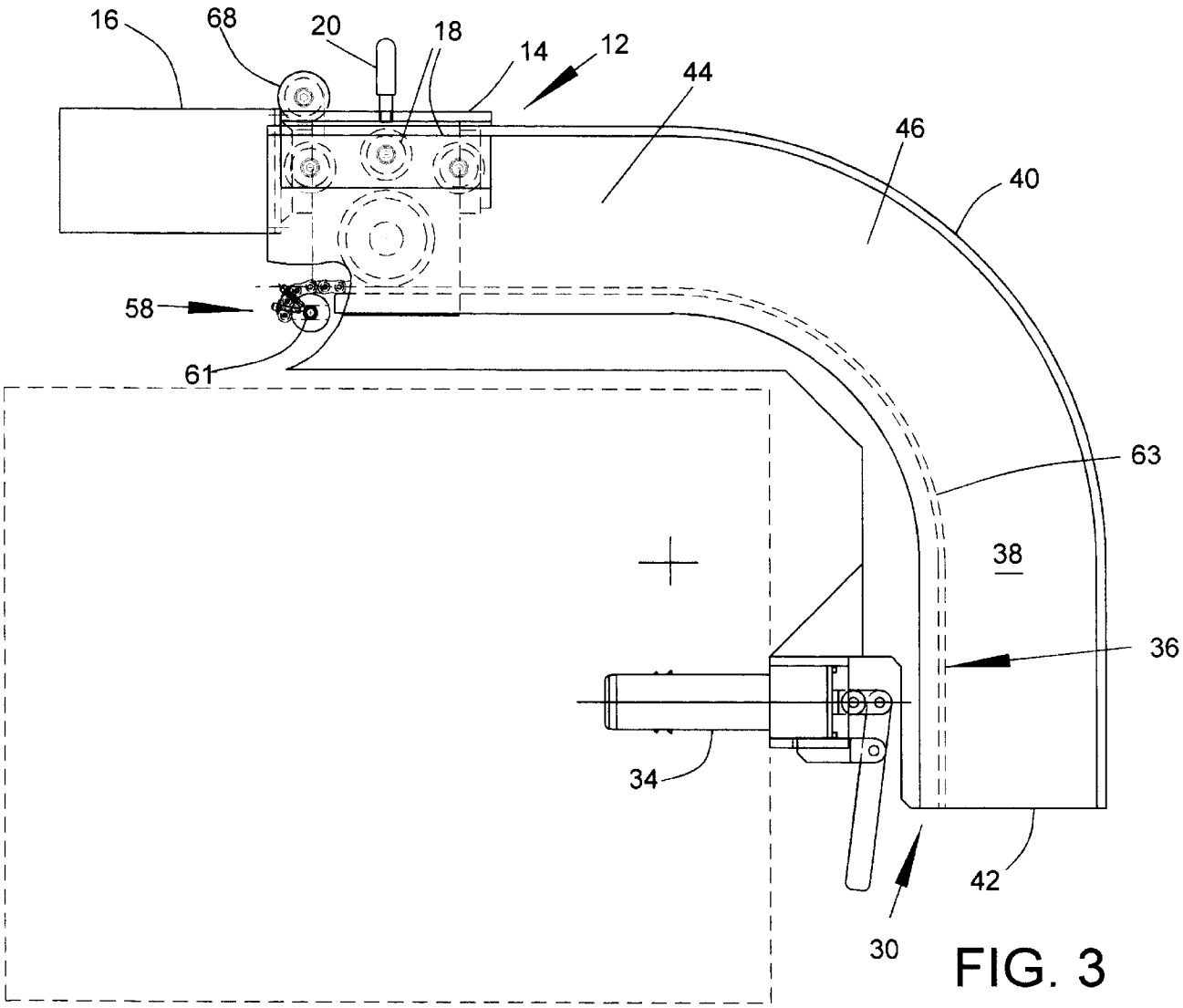
FIG. 3 represents a front elevation, in the same scale and direction as FIG. 1 and showing the roll support in a second position, this view also showing the roll of material, in dashed outline, after ninety degrees of rotation to a substantially horizontal position.

Referring to FIGS. 1, 2 and 3, a power assisted roll handling apparatus, generally identified as 10, includes a support frame assembly 12. This support frame assembly 12 includes a frame 14, a gearmotor 16, a guiding means 18 and an attaching means 20. The gearmotor 16 is removably fastened to the frame 14 by suitable threaded fasteners. One example of a gearmotor 16 is driven by an integral electric motor. In certain situations, it may be necessary to power the gearmotor 16 by a fluid powered motor. The output shaft of the gearmotor 16 includes a drive means 17, such as a sprocket, gear or the like.

At least one guiding means 18 is also removably fastened to the frame 14. One example of a guiding means 18 is a pair of flanged bearings that are arrayed in opposed relationship. One preferred example of a flanged bearing is commercially available from McGill Mfg. in its FCF series or its commercially available equivalent. One example of an attaching means 20 is a closed eye bolt, but not limited thereto. Of course, all of the components associated with the support frame assembly 12 must be chosen to satisfy load and safety requirements.

The apparatus 10 of the present invention also includes a roll support assembly 30. This roll support assembly 30 includes a shaped support beam 32, a roll core mandrel assembly 34, and a rack member 36.

The support beam 32 preferably includes a web portion 38 and a flange portion 40. The support beam 32 further includes a first end 42, a second end 44 and a radial or arced portion 46 therebetween. The radial or arced portion 46 connects the first end 42 with the second end 44 to form a continuous L-shaped beam having an included angle in the neighborhood of ninety degrees. It is preferred that the beam has a T-shaped cross section for balance purposes but not limited thereto. When a T-shaped support beam is used, the roll core mandrel assembly 34 should have its center in alignment with the centerline of the web portion 38, as may be seen in FIG. 2. It is to be noted that the web portion 38 may need to include a cut out portion for clearing certain size rolls of material, shown in dashed outline.

Example s of a roll core mandrel assembly 34 and the operation thereof is described and disclosed in U.S. Pat. No. 5,513,944 and/or U.S. Pat. No. 5, 5,642,979. Each of these patents are solely owned by the owner of the present invention and are incorporated by reference to the extent that the law allows.

The rack member 36 is supported and carried by the web portion 38. One example of a rack member 36 is a double strand roller chain 48 that is supported on a bent support rail 50. One end 52 of the roller chain is removably fastened to the support rail 50 by a suitable fastening means 54 such as threaded screws, bolts, clamps and the like. The second or distal end 56 of the chain is attached to roll support assembly 30 by means of a take-up arrangement 58. One example of a take up arrangement 58 is a roller member 60 that is adapted for attaching the second end 56 thereto by the fastening means 54. This roller member 60 is rotated until the chain 48 is brought to a taut condition, then locked in place by a suitable clamping screw 61 arrangement. A pitch line 63 of the rack member 36 is positioned in a spaced parallel relationship with the flange portion 40. This means that the radius of the radial portion 46 and a curved portion 62 of the rack member share a common center 64. It is to be noted that a linear type of take up means, slide or screw may be substituted for the roller 60.

The flange portion 40 of the support beam 32 is movably guided and carried by at least one pair of opposed guiding means 18. The overall width, between the edges 66, of the flange portion 40 should be accurately machined to minimize binding during selective movement of the roll support assembly 30 while simultaneously providing the required guidance. The contour of each of the edges 66 should match the profile of the flange of the guiding means 18.

In operation, the roll core mandrel assembly 34 is inserted into a core of the roll of material. The mandrel assembly 34 is locked into the core of the roll of material. The lifting apparatus and/or hoist line lifts the roll turning apparatus 10 a selected distance to allow the material to clear the floor as and when the axis of the roll is rotated or turned to a new angular position. The operator energizes the gear motor 16 and the drive means 17 is engaged and meshed with the rack member 36. In the roller chain example described above, the drive means 17 would be selected from a group of matching double strand roller chain sprockets. Energizing the gearmotor 16 in an appropriate direction moves the roll of material, shown in dashed outline, from a substantially vertical position as shown in FIG. 1 to a substantially horizontal position as shown in FIG. 3. The rotation of the drive means 17 moves the roll support assembly 30 from its first end through its curved portion 62 to and towards its second end 56. The length of the linear portion of the first end 42 and second end 44 determines the extent of any horizontal movement of the roll of material prior to or after the turning of the roll of material. This horizontal movement is useful in sliding the roll of material onto a material stand. It is to be noted that in some applications, it may be necessary to provide at least one guide bearing 68 that supports the outer surface of the flange portion.

It is to be noted that a spur gear and gear rack assembly may be used in place of the sprocket and roller chain arrangement shown and described.

Directional terms such as "vertical", "horizontal" "front", "back", "in", "out", "downward", "upper", "lower" and the like may have been used in the description above. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A power assisted roll handling attachment for a lifting apparatus including:

(a) a support frame including an attaching means, a gearmotor assembly, and a guiding means;

(b) a roll support assembly including a support beam, a roll core mandrel assembly, and a rack member, said support beam having a selected cross section including a flanged portion and a web portion, said flanged portion further including a first end, a second end and a radial portion, said radial portion connecting said first end with said second end and forming an L-shape, said roll core mandrel assembly being located near one of said ends and being further arrayed for selectively gripping an inside diameter of a roll of material, said rack member being supported and carried by said web portion, said rack member having a pitch line that is aligned in a spaced parallel relationship with the first end, said second end, and said radial portion, a curved portion of said pitch line sharing a common center with said radial portion of said flanged portion; and wherein said flanged portion of said roll support assembly being movably carried by said guiding means and said roll support assembly being selectively movable with respect to said support frame by engagement of a drive member of said gearmotor assembly with driven members along the pitch line of said rack member, and selective operation of said gear motor assembly displaces a center axis of said roll of material from a first angular position to a second angular position.

2. An attachment as recited in claim 1 wherein the guiding means includes a pair of flanged roller bearings that are arrayed in an opposed relationship.

3. An attachment as recited in claim 2 wherein the attaching means is a closed eye bolt.

4. An attachment as recited in claim 2 wherein said rack member is a double stranded roller chain.

5. An attachment as recited in claim 2 wherein said rack member is a double stranded roller chain having one of its ends removably fastened to a support rail having a curved portion and a second end of the roller chain is attached to the roll support by a take-up assembly.

6. An attachment as recited in claim 5 wherein said take up assembly is a roller member that is arrayed for rotation about its center for selectively bringing the roller chain to a taut condition.

7. An attachment as recited in claim 2 wherein each edge of said flanged portion is contoured for closely matching a flange of the guiding means.

8. An attachment as recited in claim 1 wherein the attaching means is a closed eye bolt.

9. An attachment as recited in claim 8 wherein said rack member is a double stranded roller chain.

10. An attachment as recited in claim 8 wherein said rack member is a double stranded roller chain having one of its ends removably fastened to a support rail having a curved portion and a second end of the roller chain is attached to the roll support by a take-up assembly.

11. An attachment as recited in claim 10 wherein said take up assembly is a roller member that is arrayed for rotation about its center for selectively bringing the roller chain to a taut condition.

12. An attachment as recited in claim 8 wherein each edge of said flanged portion is contoured for closely matching the guiding means.

13. An attachment as recited in claim 1 wherein said rack member is a double stranded roller chain.

14. An attachment as recited in claim 1 wherein said rack member is a double stranded roller chain having one of its ends removably fastened to a support rail having a curved portion and a second end of the roller chain is attached to the roll support by a take-up assembly.

15. An attachment as recited in claim 14 wherein said take up assembly is a roller member that is arrayed for rotation about its center for selectively bringing the roller chain to a taut condition.

16. An attachment as recited in claim 1 wherein each edge of said flanged portion is contoured for closely matching the guiding means.

* * * * *